US005639513A

United States Patent [19]

Latham

[11] Patent Number: 5,639,513

[45] Date of Patent: Jun. 17, 1997

[54] METHOD FOR MARBLEIZING AN OBJECT BY DIPPING THE OBJECT INTO A PAINT FLOATING ON CREAM-OF-TARTAR-CONDITIONED WATER

[76] Inventor: Elaine Latham, 308 Glyndon Dr., Reisterstown, Md. 21136-2139

[21] Appl. No.: 550,466

[22] Filed: Oct. 30, 1995

[51] Int. Cl.[6] ..... B05D 5/06; B05D 1/20; B05C 3/00

[52] U.S. Cl. ..... 427/263; 427/281; 427/434.3; 427/434.5; 118/402

[58] Field of Search ..... 427/263, 268, 427/274, 280, 281, 434.3, 434.5, 149, 152; 118/402

[56] References Cited

U.S. PATENT DOCUMENTS

| | | | |
|---|---|---|---|
| 1,931,667 | 10/1933 | Loefscher | 427/268 |
| 3,985,922 | 10/1976 | Thornton et al. | 427/345 |
| 5,348,766 | 9/1994 | Latham | 427/202 |

FOREIGN PATENT DOCUMENTS

| | | | |
|---|---|---|---|
| 6516 | of 1899 | United Kingdom | 427/149 |
| 276864 | 5/1927 | United Kingdom | 427/281 |
| 618883 | 3/1949 | United Kingdom . | |

*Primary Examiner*—Shrive Beck
*Assistant Examiner*—Fred J. Parker
*Attorney, Agent, or Firm*—Browdy and Neimark

[57] ABSTRACT

A method of using compositions and kits for preparing a marbleized coating on the surface of a sheet or object involves floating multiple color coating materials on the surface of water and dipping the sheet or object directly into this two phase liquid system. The color coating forms its own design on the water surface and does not need to be moved around. The resulting sheet or object is coated with a marbleized coating which is flexible and permanent. The water is conditioned with cream of tartar prior to carrying out the coating method.

9 Claims, No Drawings

METHOD FOR MARBLEIZING AN OBJECT BY DIPPING THE OBJECT INTO A PAINT FLOATING ON CREAM-OF-TARTAR-CONDITIONED WATER

FIELD OF THE INVENTION

The present invention is directed to decorating articles and especially to methods for coating surfaces of articles with a multicolored pattern, and more particularly is directed to an improvement of my earlier U.S. Pat. No. 5,348,766.

BACKGROUND TO THE INVENTION

Coating the surface of solid materials may be conventionally performed by dipping the solid material into a liquid coating composition. This technique has been enhanced by floating the coating material on another liquid. As the coating material floats on the surface of the other liquid, a layer may be formed which will then coat as a more uniform thin layer on the object being coated. This technique has been applied to both sheet material as well as three dimensional objects.

Bothwell, U.S. Pat. No. 846,774, is a very old example demonstrating the concept of floating a thick layer of paint on water and then dipping a sheet or other object in the liquid to apply a thin film of paint as a permanent coating on the articles being treated. Also see Dewer U.S. Pat. No. 304,802 and Davis U.S. Pat. No. 2,087,504.

In more recent years, a number of variations on this method have been used with numerous devices for continuously coating objects. Several different additives to one or more reagents have been proposed. Loetecher, U.S. Pat. No. 1,931,667, discloses marbleizing the surfaces of objects by dipping the object into a water bath with a multiple oil color paint surface layer floating thereon. The colors in the oil paint may be applied in any design, preferably one with irregular patterns resembling marble. To keep the paints from flowing and to fix the design to the dipped object, Leetacher adds alum to a soapy water solution to form a scum which will bind the colors and fix them in a particular orientation. The color layers may then be cut in any shape and oriented as desired.

Various materials have been added to the floating paint surface to impart special visual effects. Other liquids have also been added to the floating paint layer to improve its uniformity and adhesion to the article being coated. For example, Bennett, U.S. Pat. No. 2,981,632, adds naphtha and other thinners to spread the floating oil colors on a water surface. Multiple paints or colors are used and materials may be added to impart different types of finishes.

Other surface effects have been provided to coating material. For example N,N-diethyl-meta-toluamide has been proposed to enhance the globule forming effect in Stimson, U.S. Pat. No. 4,490,413.

Dip coating methods have also employed soft water and a number of thinners such as turpentine, naphtha, etc. to form thin films of oil dyes on the surface of the water. One such example is Hidan, U.S. Pat. No. 4,091,126. The object resulting after coating has a marbleized surface on a solid article.

To thin paint, a large number of hydrophobic solvents have been proposed. An example is given in Bone, U.S. Pat. No. 1,343,387, using terpineol and kerosene. Other examples are given in Skinner, U.S. Pat. No. 3,245,821, using kerosene and naphtha among other materials, and Licata, U.S. Pat. No. 2,320,527, using turpentine, mineral spirits, naphtha and other non-polar organic solvents in paint to cause thinning of the paint.

Previous attempts with paints have found that paints do not spread on water in sufficiently thin layers in a manner which allows them to almost disappear on the surface and when adding new color will also spread and start to condense the transparent colors and form a design. Furthermore, the aforementioned techniques of the prior art have not been satisfactory for forming a thin paint surface on a coated object. Thus, a variety of attempts have been made to modify the conditions to use floating paint. Thick layers and a non-flowing layer of paint on a pasty support have been proposed. However, these techniques lack the flexibility and require artistic talent to paint a design on the surface before the object is contacted on the surface. Also movement of the design was not readily performed and the paint layer was much thicker.

Lead based paints were used in the past. In recent years, the toxic effects of lead have become of greater concern. However, the physical properties of lead-free paints differ from those of lead-containing paints and as a result the conditions need to be modified. Therefore, the use of lead-free paint would be a desirable product to use. However, a simple method for spreading a very thin mobile layer of paint on a water surface for coating of an object upon directly dipping an object was not achieved with sufficiently thin films of paints until the advent of the invention of my above-identified U.S. Pat. No. 5,348,766, which has served the industry very well and has proven to be highly successful.

In accordance with the invention of my above-identified U.S. Pat. No. 5,348,766, the water on which the paint is floated is first conditioned with borax. However, borax if accidentally eaten can be toxic and therefore desirably is to be avoided if possible, especially in conjunction with products and processes in which children are involved.

SUMMARY OF THE INVENTION

It is accordingly an object of the present invention to overcome deficiencies in the prior art, such as those mentioned above.

It is another object of the present invention to impart a marbleized surface coating on an object by floating plural colors of paint on water and then dipping a clean, dry object directly into the water with floating paint to directly transfer the floating paint design to the object.

It is a further object of the present invention to produce a marbleized design which is modifiable and readily controllable once paint has been placed on the surface of water.

It is yet a further object of the present invention to assay for water being properly conditioned with a non-toxic substance so that paint readily spreads on the surface of water, especially an ultra-thin layer of paint which is so thin that it can hardly be seen when floating on the surface of the water.

It is still another object of the present invention to prepare a kit for convenient use of lead-free paints to prepare a marbleized coating on an object, and without the use of potentially toxic borax to condition the water.

It is yet another object of the present invention to provide a mix of appropriate paints and other thinners and solvents so that the paints will spread in an ultra-thin layer on a water surface.

It is still further an object of the present invention to spread paint on a surface of water without applying thickeners such as paste to the water.

It is further another object of the present invention to prepare a marbled design without the need for artistic talent or the hand painting of a marbled design, and can be successfully used by children.

The present invention thus relates to a direct transfer method for coating an object by dipping it into a container of water which has an ultra-thin layer of paint floating on the water surface. The water is preconditioned by adding cream of tartar, i.e. potassium bitartrate, sometimes also called potassium acid tartrate, $C_4H_5KO_6$, so that the paint will spread in an ultra-thin layer over the water surface. Plural colored paints spread on the surface and actually form their own design if properly placed on the water surface. This design will transfer a mirror-like image to a clean dry surface of an object penetrating the ultra-thin paint film on the water surface. If the design is not satisfactory, by blowing at the edge of the bucket, the paint may be moved and the design will change. The paints can also be moved by using a toothpick to form many intricate designs as if drawing with a brush. When the paint starts to dry, it is time to stop and make the transfer. Paint compositions, kits and assay methods for appropriately conditioned water are also aspects of the invention.

DESCRIPTION OF THE PREFERRED EMBODIMENT

To begin the process, the water must first be conditioned with the cream of tartar. Water impurities, chlorine, fluorine, pH and the amount of hardness differ with water sources, with harder waters requiring slightly more cream of tartar than soft waters. All water must be tested for conditioning before use. After filling a suitable container, e.g. a tray, bucket or fish tank, with room temperature water, about one-half teaspoon to one teaspoon, depending on the water, of cream of tartar is initially added to each one gallon of water. The solution is stirred until the cream of tartar is dissolved. The cream of tartar solution should be allowed to age for at least about 30 minutes to condition the water. A container deeper and wider than the object being decorated is necessary. Any container that holds water will work. Generally, the container depth should exceed the size of the object being coated or the portion of the object being coated. The container may have an inner liner which is removable for easy cleanup of paint floating to the edge of the water to coat the sides of the container at the water line. The inner liner may be made of waterproof tape or other easily removable and disposable material.

The cream of tartar must be dissolved and the water given ample time, e.g. 30–45 minutes, to condition.

The water solution containing an initial dose of cream of tartar is then ready to be tested for proper conditioning by placing a drop of paint on the water in the center of the container being used. If the water is sufficiently conditioned, the paint will float and spread on the water and seem to disappear.

Insufficient conditioning of the water will cause the paint to sink or fail to adequately spread. If this result occurs, additional cream of tartar is added and the process repeated until the paint adequately spreads on the surface of the water. Adequate spreading occurs when the paint color moves, opens up and seems to disappear. If too much cream of tartar has been added, the design eventually produced may break apart, become grainy or have tiny holes in the paint design.

The conditioned water may be used many times by skimming its surface with an absorbent material to adsorb and remove the remaining paint layer. Waste newspaper and the like are well suited for this function.

The objects to be marbleized (except for paper or fabric) are first cleaned. Using a rag with turpentine or mineral spirits is an acceptable means, provided the surface is made free of dust. Porous surfaces, such as wood or bisque, are sealed with paint, shellac, acrylic spray or a sealer primer stain block. Metal objects may also benefit from a coating on the surface, but such coating is not necessary for metal objects. The object may be pre-coated with a semi-gloss enamel paint of any color. This pretreatment permits one to use less marbling paint. After cleaning, the objects are allowed to dry, if not already dry, to permit the paint to stick to the objects. If there is a residue, water spots or oil from fingers, the paint will not adhere to that area.

The color of the object can become the background color in the final product. If the natural surface is desired as a background, the object may be coated with a clear shellac or similar clear material. The choice of objects to be coated is almost limitless provided that they are clean, dry and sufficiently non-porous. Glass, wood, metal, fabric, paper, ceramics, plastic, wax and rubber are among the numerous solid objects which may be marbleized. Almost anything that can be put into water without dissolving or reacting can be marbleized. The shape of the object being coated is not critical provided that the container is wider and deeper than the object.

In order to make a design, one must use a minimum of two colors. When properly placed and enough opposite colors are used, a design will form. The floating wet paint film is fluid and may also be moved around to form another design, if desired. The first drop of paint applied to the water surface will form the background color for the design, provided that it covers most of the water surface. As each new color is added, the actions of one color push against another color forcing the colors to condense and form a marbled design. Drops of paint may be added by free falling drops close to the water surface or by touching a paint coated applicator to the surface of the water. When the first drop of paint is added to the center of the water surface, the paint will spread so thin that the drop appears to disappear leaving an ultra-thin film on the water.

Additional drops of one or more different colors of paint must also be added inside the outer edge of the first color and will push the first color of paint away, each color fighting for space. The second and/or later colors are always added within the last preceding drop of paint that has opened and spread, preferably always placing the drops at 12 o'clock, 4 o'clock and 9 o'clock to balance the action of using opposite colors and to produce a marbleized effect. If too much cream of tartar has been added, the design eventually produced may break apart or become grainy. As more colors of paint are placed on the water, the design will keep building and changing. When a pleasing design is formed, wait until the paint stops moving and it is time to dip an object.

The amount of paint added to the surface depends on the size of the container and the object being dipped in the water. The paints are lead-free, oil based and insoluble in water. The paints do not mix but rather one color pushes the other color(s) across the water surface. The wet paint films will float side-by-side on the surface of the water and will not mix together. The more drops of paint added, the more intense the color becomes. By adding the appropriate amount of thinners or diluents and paint conditioners, the wet paint will readily spread over the water surface. The diluent or thinners, if used, should be added to the paints and never to the water.

The process may be repeated by dropping or lightly touching the water with wet paint into areas of a different color while the paint is still active. Each time a drop of wet paint is added, the added paint will form a film which will push the existing wet color film aside. The placement of the drops of paint is not critical for functionality but is important to forming the desired design. The total amount of paint will vary with the amount of surface area to be covered. As an example, about 15–30 drops of paint are needed to cover the surface of water in a typical three to five gallon bucket having a diameter of about one foot, i.e. having a surface area of about 100 to about 150 square inches. While the exact thickness of the floating paint film has not been measured, it is very thin, much thinner than that used previously by some other coating techniques.

Enough paint must be added to form a design. The placement of the drops is important for the proper formation of a design. The first wet paint in the form of one or a few drops is placed in the center of the container. Subsequent drops of wet paint of one or more other colors are generally placed within the edges of the first wet paint color film and will open up to form a design.

In more detail, the thin film of paint colors floating as a pattern on the conditioned water is preferably carried out by placing one or more drops of a first color at the center of the container, at which time this first color will spread and practically disappear, forming an ultra-thin film on the surface of the conditioned water. A second color is then placed in three or four different areas inside the first color but at the outside edge, such as at the twelve o'clock, four o'clock and nine o'clock positions, and these drops of the second (or second, third and fourth) colors will open up and push the first color film back toward the center of the container and thus form a marbleing design or pattern. Then, another drop of the first color can then be placed inside the area where the second (or third or fourth) color opened, and this will force the second (or third or fourth) color to move towards the center of the bucket and intensify. Approximately twenty drops of paint colors are sufficient for a twelve inch circumference container, and this will form a highly satisfactory design or pattern which need not be moved or stirred.

Thus, there are two ways designs are formed. When properly placed on the water and enough paint is used, they create their own design. If the design is not satisfactory, it can be changed by carefully drawing a tooth pick or similar object through the wet paint films moving one or more of them gently, and the design keeps taking new shapes. This must be done before the paint starts to dry.

If so desired the pattern may be altered after it has been initially formed. Shapes may be moved around on the surface of the water using one or more toothpicks or similar objects and the design can be completely changed. Any design pleasing to the user may be made and then directly transferred to an object.

Depending on the temperature and humidity conditions, a variable amount of time will be allowed to pass to partially dry the paint films on the water surface. Under hot dry conditions the paint may dry in a matter of minutes. Under cooler humid conditions, the paint may need to set several minutes before commencing dipping. Once the paint has started to dry, it will adhere to almost any surface. Partial drying causes the paint to become less fluid which alters the way of making a design. The water helps to set the paint as soon as it transfers from the water to the object.

When an object has been dipped, before it is pulled from the water, a clean area is made on the water surface by blowing on the surface of the water to push away the remaining floating paint films as otherwise the object will pick up the excess paint on the way up and ruin the design.

In the case of a large object in a large container, other objects may be dipped to use up the paints as long as the first object is held beneath the water. Before bringing the object out, the excess paint should be skimmed off with newspaper so the design will not be ruined.

If the paint runs when the object is removed, the paint needs to partially dry longer before dipping an object, the object is not dry or too much cream of tartar has been used for the water conditioning, in which latter case additional unconditioned water should be added to the over-conditioned water. Generally, there is a five to ten minute time period when the paint is adequate for decorating objects by direct transfer.

The same colors may be applied sequentially to multiple objects by sequentially dipping each of these objects into the water. Each time, the pattern will appear lighter and will change on an object being coated. When one wishes to use a different color pattern, paint may be removed from the surface with waste newspaper or the like to adsorb the paint and a new design produced. Fresh paint cannot be added to the water with an old design. As noted above, the water may be reused. After many uses the water should be changed and conditioned again with the cream of tartar. After a lot of use, the paints may slow down, and a very small amount (¼–½ teaspoon) of cream of tartar can be added to activate the paints.

The present invention is the first to effectively coat an object by direct transfer. The object is directly lowered from above the surface so that it first contacts the floating paint and then is set by the water carrier below. The paint or water does not need to be swirled or painted on the surface. Significant to this direct transfer technique is that the colors of paint adhere to the object as if it were a magnet, and do not run or peel off.

When the sheet or object is dipped into the solution, the bath transfers the paint from the water surface to the surface of the sheet or object. Any paint film remaining on the water surface may be blown to one side, and the coated object then removed; or if a fish tank with a divider at the water surface is used, the coated object may be passed beneath the divider and removed through the uncoated part of the water surface on the other side of the fish tank. If the sheet or object does not have sufficient rigidity for easy handling, the sheet or object may be attached to or filled with other material, such as a clothing form of plastic or cardboard, to impart sufficient rigidity to the object to facilitate dipping.

An object that is to be only partially decorated can be masked off, e.g. with masking tape which can be removed after the transfer is made. Such a technique can be used with solid objects such as the soles of shoes or sneakers. Clothing can be decorated with other fabric that has been dipped and allowed to dry and either sewn or pressed on with a special press-on product. To decorate a small area of a T-shirt, the selected portion of the shirt can be placed in an embroidery hoop and masking tape is put around the edge of the hoop to protect the rest of the material from the paint. The design is transferred by placing flat on the water instead of dipping.

If the particular design is not to the liking of the user, the object may be allowed to dry and another color combination and design may be transferred over the first design. The combination may create a very interesting layered effect. Before the paint is dry, it may be removed with any conventional paint solvent and then another coating applied, except on fabric, paper and other material which will have absorbed the paint.

If so desired, either the paint or the freshly painted object may attach one or more small articles to the object by contacting the wet paint. Such small articles would then become part of the coating and impart a decorative effect. Examples of small articles include glitter, powders, beads, flakes and fibers. The object should be allowed to air dry.

A test kit may be formed by including at least two containers of paint. Each container contains only one color paint. The test kit may also include cream of tartar, written and/or audio and/or video tape instructions, applicators for moving paint on the water surface and/or objects to be coated.

The paints used in the kit, including thinners or diluents, were prepared according to the formulas given in the Table below.

The amount of each ingredient is important to the proper functioning of the paint. Variations of as little as a few percent can adversely affect the ability of the paint to spread and flow, its smoothness, the drying time and how well it sticks to the article being dipped. In general, the flash point of the diluted paints is between 112° and 117° F.

The components vary slightly from batch to batch and with different manufacturers. Each batch must be individually tested for spreading on the conditioned water surface, preferably against another paint composition which does spread. Variations on the above compositions may be needed and should be employed when the paint does not spread on conditioned water.

FORMULAS
UNITS ARE FLUID OUNCES

| COLOR | PAINT BASE | PETROLEUM DISTILLATES | ALIPHATIC PETROLEUM DISTILLATES |
|---|---|---|---|
| WHITE | 128 | 12 | 44 |
| BLACK | 128 | 0 | 24 |
| YELLOW | 128 | 32 | 18 |
| PURPLE | 128 | 24 | 8 |
| TEAL | 128 | 32 | 24 |
| ROSE | 128 | 24 | 8 |
| BLUE | 128 | 32 | 18 |
| PEACH | 128 | 24 | 24 |
| BROWN | 128 | 24 | 24 |
| RED | 128 | 24 | 32 |
| GREEN | 128 | 24 | 24 |
| DARK BLUE | 128 | 16 | 12 |
| AQUA | 128 | 24 | 32 |
| BURGANDY | 128 | 32 | 24 |
| ANTIQUE BLUE | 128 | 16 | 18 |
| PLUM | 128 | 30 | 20 |
| WINE | 128 | 24 | 12 |
| EVERGREEN | 128 | 24 | 20 |
| VICTORIAN LACE | 128 | 16 | 48 |
| HEATHER GREY | 128 | 20 | 16 |
| PUMPKIN | 128 | 20 | 20 |

The composition of the ingredients of each component are as follows:

The Aliphatic Hydrocarbon contains: Naptha (petroleum) Heavy alkylate—100% CAS# 64741-65-7; Flash point 93° F., 100% volatile, BP 162° C., 400° F., Density 6.3 lbs/gal at 68° F., vapor pressure 7.8 mm Hg at 20° C.

Petroleum Distillate contains: 63% petroleum distillates <6% CAS# 8008-20-6 and >57% CAS# 864742-88-7, flash point 125° F., 70% volatile, Boiling range 300°–500° F., Density 7.1 lbs/gal at 75° F., vapor pressure 1.0 mm Hg at 70° F.

Base Paint: Lead-free, high gloss enamel high hiding white alkyd paint, 45% Mineral Spirits CAS# 64742-88-7, 25% Titanium Dioxide CAS# 13463-67-7, Flash point 116° F., boiling point 302°–390° F., density 9.4 lbs/gal., 56 % volatile, 8.3 lbs/gal. Pigments vary based on the color. The paints are easily mixed prior to use to provide different shades and colors.

The foregoing description of the specific embodiments reveal the general nature of the invention so that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation.

All references mentioned in this application are incorporated by reference.

What is claimed is:

1. In a method for coating a surface of an object with a design, comprising floating a plurality of different colored oil-based paints on a surface of a water conditioned by the addition of a conditioning agent in sufficient amount so that the paints spread in a thin layer floating on the surface of the water containing the conditioning agent, dipping an object into the conditioned water having the thin layer of paints floating on the surface so that the object contacts the thin layer of paints floating on the surface, removing the object from the water, and drying the object to form a coated object which maintains the design, the improvement wherein said conditioning agent is cream of tartar.

2. The method according to claim 1 further comprising sealing the surface of the object before it is dipped into the conditioned water.

3. The method according to claim 1 wherein the oil-based paints are lead-free.

4. The method according to claim 1 wherein the oil-based paints are applied sequentially to the surface of said conditioned water.

5. The method according to claim 4 wherein, after said paints are applied, the paints are moved over the water surface to form a pattern.

6. The method according to claim 1, further comprising contacting the coated object to a second object, before the paints fully dry, and thereby transferring said coating from said first object to said second object.

7. The method according to claim 1, further comprising applying a plurality of articles, smaller than said object, to said coated object before the paints dry, said articles being selected from the group consisting of glitter, powder, beads, flakes, fibers and mixtures thereof.

8. A method for coating a surface of an object with a paint design, comprising conditioning a quantity of water by adding cream of tartar thereto to form a cream of tartar solution, and providing said cream of tartar solution in the form of a bath having an upper surface, floating a first colored thinned paint on said upper surface of said cream of tartar solution so that a first drop of thinned paint spreads in a thin paint layer with an outer peripheral edge over said upper surface sufficiently thin so that said first drop appears to disappear, floating at least one differently colored thinned paint on said upper surface of said cream of tartar solution within said outer peripheral edge of said first color layer to form at least a second color layer over said upper surface, said first and second colors being in edge-to-edge contact, coating an object by dipping said object into said cream of tartar solution through said first color layer and said second color layer so that the surface of the object contacts the first color layer and the second color layer floating on the cream of tartar solution surface, and removing the object from the cream of tartar solution and drying the object to form a coated object.

9. A kit for coating a surface of an object comprising at least two containers, each said container containing a different oil-based paint capable of spreading to an ultra-thin film when a drop of said paint is placed on a surface of water which has been conditioned with cream of tartar; a separate container of cream of tartar; and instructions selected from the group consisting of written instructions, audiotape instructions, videotape instructions and more than one form of said instructions.

* * * * *